United States Patent [19]

Vanderpool et al.

[11] 4,338,126

[45] Jul. 6, 1982

[54] RECOVERY OF TUNGSTEN FROM HEAVY METAL ALLOYS

[75] Inventors: Clarence D. Vanderpool, Towanda; Robert P. McClintic, Monroeton, both of Pa.

[73] Assignee: GTE Products Corporation, Stamford, Conn.

[21] Appl. No.: 157,630

[22] Filed: Jun. 9, 1980

[51] Int. Cl.[3] ..... C22B 34/36

[52] U.S. Cl. ..... 75/84; 75/63; 75/72; 75/82

[58] Field of Search ..... 75/63, 84, 0.5 BB, 176, 75/82, 72

[56] References Cited

U.S. PATENT DOCUMENTS

| | | | |
|---|---|---|---|
| 2,407,752 | 9/1940 | Trent | 75/63 |
| 3,767,381 | 10/1973 | Bielefeldt | 75/63 |
| 4,138,249 | 2/1979 | Rosof | 75/63 |

*Primary Examiner*—M. J. Andrews

*Attorney, Agent, or Firm*—Robert E. Walter

[57] ABSTRACT

Tungsten is reclaimed from heavy metal alloys of the type having tungsten metal dispersed throughout a matrix material by treating the heavy metal alloy with zinc to form a molten mixture and separating the zinc from the resulting alloy.

3 Claims, No Drawings

RECOVERY OF TUNGSTEN FROM HEAVY METAL ALLOYS

BACKGROUND OF THE INVENTION

The present invention relates to the recovery of tungsten from heavy metal alloys. Heavy metal alloys are extensively used as shields or containers for radio active materials, as gyroscope rotors, counterweights, and corrosion resistant parts for jet air craft, and as armor penetrating projectiles and rocket nose cones.

Such alloys are dense, hard and corrosion resistant. Due to their nature, recovery of various valuable metal components is difficult. Typical recovery methods employing conventional acids, bases of other solvents are generally slow, expensive and otherwise generally ineffective from the standpoint of a commercial operation. U.S. Pat. No. 2,716,558 to Hall describes a process for recovering nickel and copper from Monel metal by introducing the alloy into an aqueous solution of strong inorganic acid, e.g. sulfuric nitric or hydrochloric acid and passing sulfur dioxide into the solution. According to this process, dissolution of the metals is slow and resulting gases are highly toxic and undesirable.

Other methods have been found impractical. For instance, acid leaching of heavy metal by hot hydrochloric acid was exceedingly slow. A cylinder approximately four inches in diameter by eight inches long was only leached to the depth of one quarter inch after thirty days using concentrated hot, hydrochloric acid at a temperature of 110° C. The use of oxidizing acids, such as nitric acid, also oxidize the tungsten producing tungsten oxide. It was also discovered that the fusion of heavy metals in sodium hydroxide is also very slow. A fifty gram piece requires sixteen hours for complete dissolution at 1000° C.

U.S. Pat. No. 3,595,484 to Barnard relates to a process for the reclamation of tungsten carbide from cemented carbides by treating the cemented carbide with molten zinc and subsequently distilling the zinc from the mass. The zinc forms an alloy with cementing agent, usually cobalt, thereby dissolving the cementing agent and permitting recovery of a mixture of the carbide and cementing agent in a form that can be reused in the preparation of cemented carbides.

British Pat. No. 582,921 relates to the recovery of refractory carbides by treatment of a scrap molten zinc and subsequently leaching the resulting alloy with an acid solution followed by recovery of products from the solution.

It is an object of the present invention to provide a process for rapidly and economically effecting the recovery of tungsten from heavy metal alloys in such a form that the tungsten may be reused to form new articles.

Other and further objects of the present invention will become apparent from reading the following description.

In accordance with the present invention, there is provided a method for reclaiming tungsten from heavy metal alloys comprising treating the heavy metal alloy with molten zinc for a sufficient period of time and at a sufficient temperature to form a resulting alloy comprising zinc and tungsten separating the zinc from the resulting alloy comprising zinc and tungsten.

DETAILED DESCRIPTION

Heavy metal alloys which are desirably reclaimed by prior art techniques consist essentially of tungsten metal dispersed throughout a matrix. Typical matrix metals include chromium, iron, cobalt, nickel, copper and mixtures or alloys thereof. The matrix is distributed around the particles of tungsten and acts to improve the mechanical properties of the heavy metal alloy. Because of the high melting point, density and other physical properties, tungsten is an attractive material for many articles of manufacture. However, pure tungsten requires high sintering temperatures and is too brittle for many applications.

Typical heavy metal alloys comprise from about 80 to about 95 percent tungsten and remainder matrix material. Even more preferably, the heavy metal alloys comprise from about 87 to about 93 percent tungsten. The preferred matrix material generally comprise nickel, iron copper or an alloy thereof. Typically alloys are of nickel and copper or nickel and iron.

The original articles are generally fabricated by mixing the starting materials uniformly, compacting and sintering to above about 95 percent theoretical density by pressing. The blended powder may be loaded into a plastic bag and isostaticly pressed to form a compact. The pressures are on the order of about 10,000 psi to form a suitable compact. The compact is then sintered in a carbon free atmosphere at a temperature in the range of at least 1200° C. The sintering time necessary to reach the required densification varies with the sintering temperature. The particle may be further work hardened to strengthen it for various applications.

In accordance with the present invention there is provided a method for reclaiming tungsten from heavy metal alloys comprising treating the heavy metal alloy with molten zinc for a sufficient period of time and a sufficient temperature to form a resulting alloy containing zinc and separating the zinc from the alloys.

It has been found that tungsten may be recovered from the heavy metal alloy rapidly and economically by treating the heavy metal alloy with molten zinc, followed by distillation of the zinc from the mixture at an elevated temperature under reduced pressure. The treatment with molten zinc results in the formation of a molten alloy with the cementing agent or matrix material and frees the tungsten from the heavy metal alloy article. When the zinc is removed from the mixture by distillation, the resulting product consists of a mixture of tungsten and matrix material in powder form. The mixture is readily ground to a powder of particle size similar to the original material and may be further reused in the preparation of heavy metal alloys. The zinc vapors are recovered by condensation and may subsequently be reused for treating additional heavy metal alloy. The apparatus employed is as described in U.S. Pat. No. 3,595,484 which is a conventional distillation apparatus which may be modified for large scale industrial application as described in the patent.

The weight ratio of zinc used in the process is from about 30:1 to 10:1 with range of about 20:1 to 15:1 being preferred. The temperature employed in the treatment with molten zinc is preferably from about 750° to 850° C. with a temperature of about 800° C. usually being optimum. The reaction proceeds at a rapid rate and is dependent on the size and shape of scrap objects.

It is also contemplated that the tungsten may be recovered after forming the alloy with zinc by contacting the alloy with an aqueous acid so as to leach the matrix material and zinc from the alloy so as to leave tungsten material.

The following examples are intended to more fully illustrate the present invention.

EXAMPLE 1

A heavy metal having the composition of about 90 percent tungsten, 6 percent nickel and 4 percent copper is mixed in a silica crux with 97.8 grams of zinc pellets. The crux or container is placed in an electric furnace which has been preheated to a temperature 550° C. The container is covered and heated in the furnace approximately 45 minutes after which the heavy metal has completely dissolved. After cooling the container a zinc alloy is present in the container. Reagent grade hydrochloric acid is added to the zinc alloy until the zinc was dissolved. A black powder residue is present after dissolving the zinc, the residue was identified by x-ray diffraction as tungsten. The hydrochloric acid contained copper and nickel.

EXAMPLE 2

About 50 grams of a heavy metal and 100 grams of zinc pellets were mixed in the silica container and covered and heated for one hour at a temperature of 550° C. at which time the heavy metal has dissolved in the zinc. After cooling, the zinc alloy with heavy metal was transferred to a vacuum furnace and the zinc distilled at approximately 800° C. After approximately five hours a black powder remained in the furnace which was identified by x-ray analysis as tungsten, copper and nickel. Because of some oxidation the powder was reduced under a hydrogen reducing atmosphere at about 400° C. Chemical analysis indicated that the powder would be suitable for reuse.

We claim:

1. A method for reclaiming tungsten metal from heavy metal alloys of the type having tungsten metal dispersed throughout a matrix material comprising treating a heavy metal alloy with zinc for a sufficient period of time at a sufficient temperature to form a molten mixture comprising tungsten metal, zinc and matrix material, and separating zinc from said molten mixture to form a powder containing tungsten metal, said heavy metal alloy consisting essentially of 80 to 95 percent tungsten metal and the balance a matrix material selected from the group consisting of chromium, iron, cobalt, nickel, copper, mixtures and alloys thereof.

2. A method according to claim 1 wherein said separating comprises heating said resulting alloy to volatilize the zinc and leave a residue comprising tungsten and matrix material.

3. A method according to claim 1 wherein said resulting alloy is contacted with an aqueous acid solution for a sufficient period of time to dissolve substantially all of the zinc and matrix material and leave a solid residue comprising tungsten.

* * * * *